US005445170A

United States Patent [19]

Yasuda

[11] Patent Number: 5,445,170

[45] Date of Patent: Aug. 29, 1995

[54] HAIR CLIP

[75] Inventor: Masahiro Yasuda, Higashiosakashi, Japan

[73] Assignee: Kabushiki Kaisha Yasuda Corporation, Osaka, Japan

[21] Appl. No.: 106,385

[22] Filed: Aug. 13, 1993

[30] Foreign Application Priority Data

Aug. 19, 1992 [JP] Japan ..... 4-220045

[51] Int. Cl.[6] ..... A45D 8/22

[52] U.S. Cl. ..... 132/279; 132/278

[58] Field of Search ..... 132/275, 278, 279

[56] References Cited

U.S. PATENT DOCUMENTS

| | | | |
|---|---|---|---|
| 2,921,589 | 1/1960 | Blomme | 132/279 |
| 3,805,813 | 4/1974 | Laughton . | |
| 4,919,155 | 4/1990 | Yasuda . | |
| 5,109,878 | 5/1992 | Kuo-Hua . | |

FOREIGN PATENT DOCUMENTS

| | | | |
|---|---|---|---|
| 2170550 | 9/1973 | France . | |
| 2635653 | 3/1990 | France | 132/279 |
| 3907716 | 9/1989 | Germany . | |
| 45-3321 | 2/1970 | Japan . | |
| 50-47698 | 5/1975 | Japan . | |
| 50-154195 | 12/1975 | Japan . | |
| 57-55403 | 3/1982 | Japan . | |
| 61-174504 | 10/1986 | Japan . | |
| 176702 | 5/1989 | Japan . | |

*Primary Examiner*—John G. Weiss

*Attorney, Agent, or Firm*—Tilton, Fallon, Lungmus & Chestnut

[57] ABSTRACT

A hair clip includes a base plate (1) secured to an ornamental cover and a pair of hooking arms (13) extending from the base plate, in which each arm has an extension protruding from an outer edge at the base portion of the arm. The extensions (13*c*) come into a sliding contact with an engaging part (4*b*) of a hair retainer (4) when it is moved towards its closed position. A shackling member (15) is provided for holding the hooking arms (13) at their overlapping position even after the arms have been unlatched. The hair clip further has a restoring member (14) which urges the shackling member (15) to return to its another position where the arms are freed, when the hair retainer (4) is opened such that the engaging part (4*b*) can no longer be latched by the hooking arms (13). Such a mechanism makes easier the unlatching of the hair clip, which is simple in structure and easy to manufacture and assemble.

10 Claims, 4 Drawing Sheets

HAIR CLIP

BACKGROUND OF THE INVENTION

1. Technical Field of the Invention

The present invention relates to a hair clip and more particularly to an ornamental hair clip for retaining hairs by and between two metal sheets by a spring force.

2. Prior Art

There are many kinds of hair clips known in the art, and disclosed for example in Japanese Utility Model Publication (unexamined) Nos.45-3321, 50-47698, 50-154195, 57-55403 and 61-174504. Those prior art hair clips generally comprise a base plate fixed to an ornamental cover, a downwardly curved and band-shaped spring board whose both ends are fixed to the base plate, and a band-shaped retainer operably disposed beneath the spring board. The retainer has a fixed end pivoted to a pair of brackets protruding from one end of the base plate, and also has a movable end formed with an engaging part which is releasably latched to a pair of hooks provided at the other end of the base plate.

These prior art hair clips retain hairs by and between the spring board and the retainer, with the engaging part thereof being held in place by the hooks. When the hairs are to be released from the clip, the movable end of the retainer is unlatched from the base plate by pressing ledges towards each other, which ledges are integral with the hooks and protrude from the base plate.

Thus, the unlatching operation of those conventional hair clips is done by gripping the pair of ledges behind the ornamental cover. However, the insertion of the user's fingers into underneath the ornamental cover is not easy, because said cover is in close contact with her or his hairs. Especially when the ornamental cover is relatively large, the hair release becomes more difficult because of a large spacing between the periphery of said cover and the ledges.

In order to resolve this problem, the present applicant has proposed a novel type of hair clip as disclosed in the U.S. Pat. No. 4,919,155. This hair clip comprises a release mechanism constructed such that the retainer only need be pressed towards the base plate having hooks or hooking arms. The pressed retainer causes the hooking arms to become so close to each other as to unlatch the retainer.

In detail, the hair clip in accordance with my preceding proposal comprises: a base plate attached to an ornamental cover and including a pair of brackets at one end and a pair of ledges at the other end; a hair retainer rotatably connected to the brackets at its one fixed end, said hair retainer having an engaging portion at its other movable end; a pair of hooking arms projecting inwards from the insides of the ledges, each arm including a leg portion capable of overlapping with the leg portion of the other arm; said engaging portion including a central dented part a pair of arched bridge parts at opposite sides of of the dented part; and a ring placed between the central dented part and the arched bridge parts, said ring having a central opening for allowing the leg portions of the arms to fit in when they overlap with each other for unlatching.

In use, this hair clip having the ring as a releaser may be removed from the user's hairs for example by pressing at first the movable end of hair retainer towards her or his head and thereafter rendering free the movable end.

When releasing the hair clip, the user need no longer insert her or his fingers in beneath the ornamental cover, contrary to the various prior art hair retainers, so as to operate the ledges. Instead of doing so, she or he who wants to remove the hair clip may simply press an end of the ornamental cover. Thus, it is a remarkable advantage that the hair clip can be removed very easily even if its ornamental cover is considerably large.

The hair clip according to my preceding proposal has however proved somewhat problematic from the following points of view.

The ring serving as the releaser has the central opening which, as mentioned above, is forced to fit on and receive therein the overlapped pair of the hooking arms. Therefore, the ring must be of a tenacity sufficient to withstand a strong outward and radial force which the forcibly fitted arms will impart to the ring.

Since the arms are strongly urged against the inner peripheral wall of the central opening, the ring must be highly resistant to abrasion. Further, the ring must not cause such an intensive friction that will hinder the arms from smoothly fitting in the central opening. Thus, the ring has to be made of a stiff material meeting all of the mentioned requirements, with the inner periphery of its central opening being nevertheless machined to have a less frictional finished surface, thereby raising the manufacture cost of such a ring.

It is noted that the ring, which is disposed between the central dented part and the opposite bridge parts both formed at the movable end of the hair retainer, is capable of moving up and down. Therefore a means for protecting the ring from slipping off is necessary, and this protecting means may comprise a pair of parallel guide posts extending from opposite longitudinal ends of the dented part. Correspondingly, slots are formed on the periphery of the ring so as to engage with the respective guide posts.

Such a protecting means will however make more complicated the structure of the ring and hair retainer. The manufacture thereof, in particular, the work for attaching the ring to the retainer becomes not easy but considerably intricate to raise production cost.

Outer hooking tip ends of the pair of overlapping arms are forced to rub the inner periphery of the central opening of the ring whenever the retainer is released. Thus, the tip ends are likely to be worn out so soon that the hair clip as a whole becomes less durable.

OBJECTS AND SUMMARY OF THE INVENTION

An object of the present invention which was made to resolve the aforementioned problems is therefore to provide a hair clip which is readily releasable from hairs of a user, simple in structure, easy to manufacture and assemble, and is improved in durability.

According to the invention, the hair clip comprises: a base plate having at one end a pair of hooking arms capable of overlapping with one another; a hair retainer having one end rotatably connected to the other end of the base plate, the hair retainer further having at the other end thereof an engaging part releasably latched by the pair of the hooking arms; a spring board interposed between the base plate and the hair retainer and shaped so as to urge the hair retainer towards its open state as long as the engaging part is latched by the hooking arms; a releasing means for releasing the hair retainer from the base plate; the releasing means comprising: clampable members each protruding outwardly from a base portion of the hooking arm so as to come into a direct or indirect contact with the engaging part, the clampable members being shaped such that when the one end of the base plate is pressed towards the other end of the hair retainer which is in its latched position the hooking arms are caused to overlap with each other to take a releasable position; a shackling member shaped to hold the hooking arms in their overlapping state even after they have taken the releasable position; and a restoring member shaped to urge the shackling member towards its free position for releasing the hooking arms as the hair retainer is rotated away from the base plate towards its open state in which the engaging part is no longer latched by the hooking arms.

Other objects and advantages of the present invention will become apparent from the description of the preferred embodiments, which may be modified in any manner without departing from the scope and spirit of the invention.

DETAILED DESCRIPTION OF THE PREFERRED EMBODIMENTS

The present invention will now be described in more detail referring to an embodiment shown in FIGS. 1 to 5C.

Figure 1:
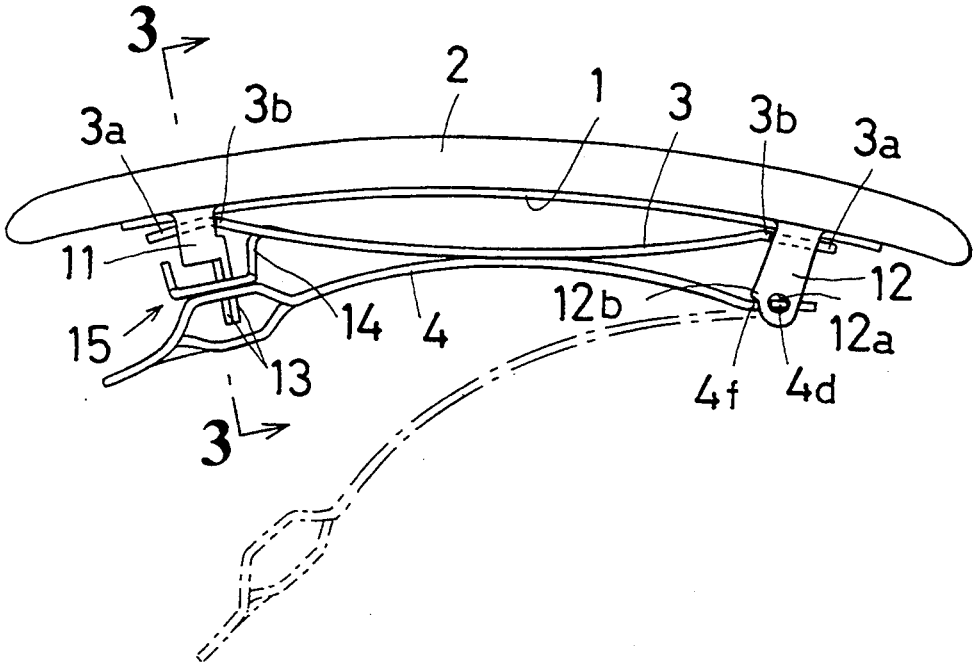
FIG. 1 is a side elevation showing in closed state a hair clip provided in an embodiment of the invention.

The words "up" or the like in FIG. 1 is used herein for convenient description of the portions nearer the top edge of the paper, with the words "down" or the like meaning the portions nearer bottom edge.

A hair clip in this embodiment comprises a base plate 1, an ornamental cover 2 attached to the upper surface of the base plate, a spring board 3, a hair retainer 4 and a releasing means.

The base plate 1 for securing the ornamental cover 2 is made of a metal sheet.

Figure 2:
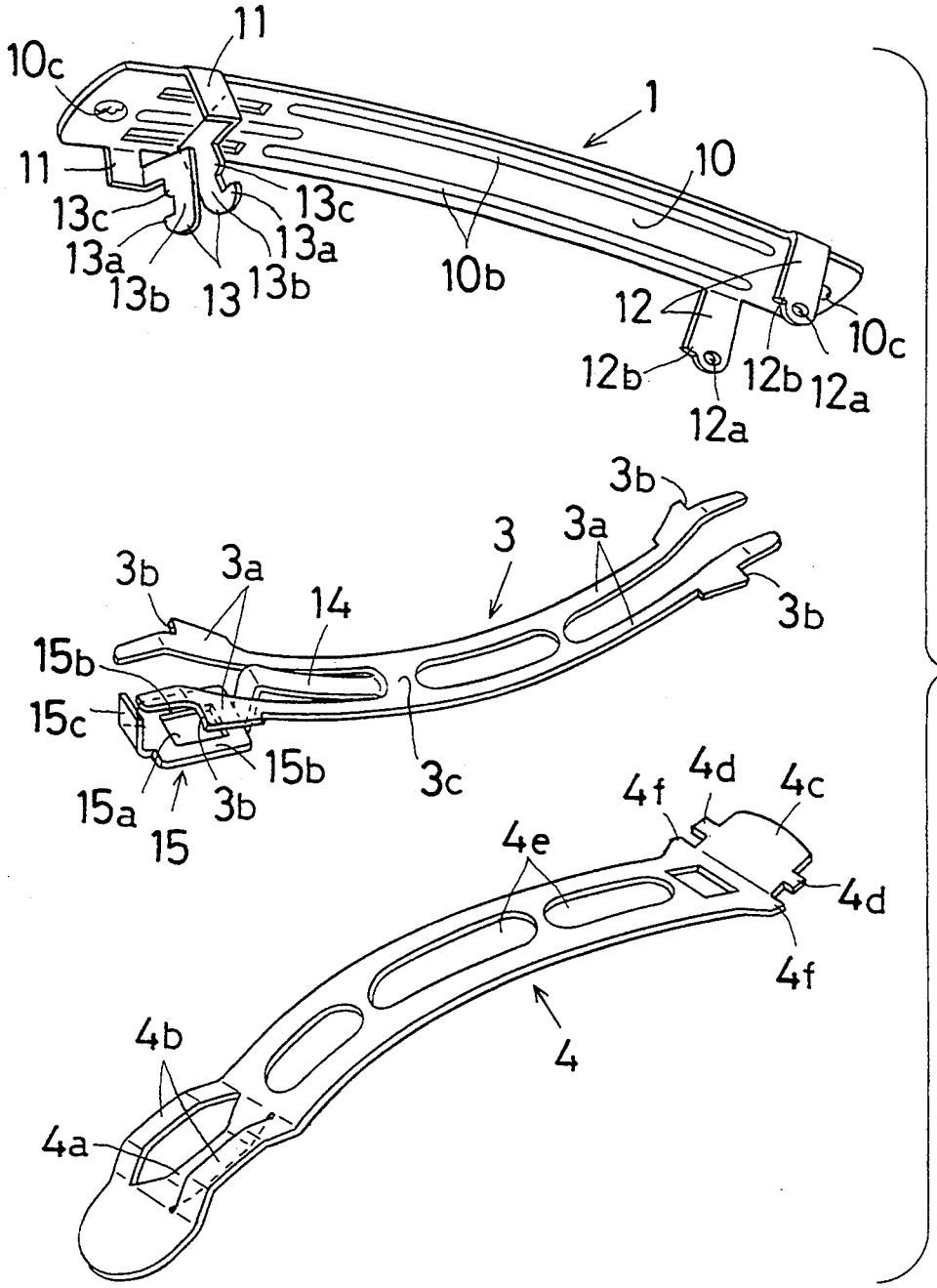
FIG. 2 is a perspective view showing in disassembled state a base plate, a spring board and a hair retainer which constitute the hair clip in the embodiment, with the base plate being adapted to attach an ornamental cover.

As shown in FIG. 2, the base plate 1 is composed of a band-shaped sheet portion 10 which is slightly curved upward, a pair of ledges 11 facing one another and downwardly protruding from opposite sides of the sheet portion at one end thereof, and a pair of ledges 12 facing one another and also downwardly protruding from opposite sides of the sheet portion at the other end thereof.

The distance between the ledges 11 is slightly expanded towards their lower ends. An L-shaped hooking arm 13 protrudes inwards from the inner edge of each ledge 11 so as to face the center of the base plate. Each of the hooking arms 13 has a vertical leg 13*b*, and these legs always overlap with one another at least partially, though the hooking arms 13 are usually caused by the ledges 11 to open towards their lower ends. Those lower ends of the arms 13 are rounded, with their outer edges being shaped to serve as hooks 13*a*.

A clampable member 13*c* is formed integral with an outer and upper base portion of each vertical leg 13*b*, and protrudes outwardly therefrom so as to provide the vertical leg with a contactable extension which constitutes a releasing means detailed below. Lower edges of the clampable members 13*c* are arcuate.

A pivot receiving aperture 12*a* is formed through a lower portion of each bracket 12, which portion has also a shoulder 12*b* formed to face the center of the base plate.

The band-shaped sheet portion 10 is reinforced with longitudinal ridges 10*b* which protrude downwardly to extend along opposite sides of said portion.

The ornamental cover 2 is a molded plastics article of a given shape, and is fixed to the upper surface of the base plate 1, by using punched holes 10*c* located at longitudinal end regions thereof.

The spring board 3 is a relatively narrow band made of a spring steel, and has an intermediate region bent downwards between its longitudinal ends.

As shown in FIG. 2, each longitudinal end of the spring board 3 is of an elongate U-shape having horizontal legs 3*a*, and which legs have at their opposite outer sides stopping shoulders 3*b* apart from the longitudinal extremity. One of the longitudinal ends having the horizontal legs 3*a* of the spring board 3 is disposed between the brackets 12, as shown in FIG. 1, with the other end which also have the horizontal legs 3*a* thereby being set in place between the ledges 11. The stopping shoulders 3*b* at one end engage with the brackets 12 and the other shoulders 3*b* at the other end engage with the ledges 11. Thus, each of the longitudinal ends of the spring board 3 is restrained not to slide longitudinally beyond a limited distance, but capable of allowing this board to elastically flex towards the base plate 1. It may suffice that alternatively only one of the longitudinal ends of the spring board 3 can slide on the base plate 1 to enable such a flexing.

The spring board 3 comprises, as a restoring member, a tongue 14 made of a spring steel and having one end integral with a junction 3*c* which unites the base regions of horizontal legs 3*a* and 3*a*. The other, or outer, end portion of the tongue 14 interposed between the legs 3*a* is bent downwards to substantially be L-shaped in side elevation.

Extending outwards from and integral with the lower extremity of tongue 14 is an annular frame 15, which is provided as a shackling member in the releasing means. The annular frame 15 extends generally in parallel with the base plate 1, and has a central rectangular opening 15*a* of such a size as allowing the lower portions of the hooking arms 13 to be inserted.

Figure 3:
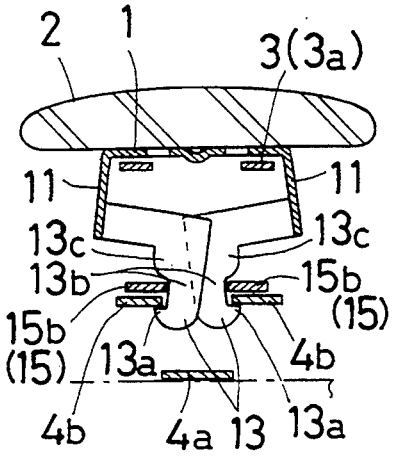
FIG. 3 is a cross section taken along the line 3—3 in FIG. 1.

FIG. 3 shows the hooking arms 13 inserted in the opening 15*a* through the annular frame 15. In this state, a pair of restrainers 15*b* which are formed as the opposite lateral sides of annular frame are disposed between each hook 13*a* and each clampable member 13*c*, i.e., the contactable extension. An outer end of the annular frame 15 is bent upward towards the base plate so as to form a stopper 15*c*, as seen in FIGS. 1 and 2.

The hair retainer 4 is a band-shaped spring steel, and its middle region intermediate the longitudinal ends is slightly curved upwards.

As shown in FIG. 2, the hair retainer 4 has a left-hand end formed with two parallel slits extending longitudinally of the retainer. A middle portion between the slits is a downwardly dented part 4a, which is interposed between two parallel and outer arched bridges 4b, which in turn are curved upwards to serve as an engaging part. A right-hand end 4c of the hair retainer is bent upwards and outwards, and small pivots 4d protrude from the lateral sides of the right-hand end. A row of three slots 4e, which extend longitudinally of the hair retainer, penetrate the intermediate region thereof.

The right-hand end 4c of the retainer is positioned between the brackets 12 and 12, as shown in FIG. 1. The pivots 4d at the end 4c are respectively inserted in the apertures 12a so that the hair retainer 4 thus mounted on the base plate 1 is rotatable relative to it. Such a hinged connection permits the hair retainer 4 to freely swing towards its closed position, until the shoulders 12b of the brackets 12 will collide with stopping lugs 4f protruding sideways from the opposite sides of the right-hand end 4c. Thus, an interim stable state appears in which a given distance is kept between the engaging part 4b and the hooking arms 13 of the base plate 1. However, the hair retainer cannot easily swing any further out of this interim state.

As described above, the hair retainer 4 in the hair clip of the invention will be opened and closed around its right-hand end 4c acting as a fulcrum so that hairs of a user are releasably clipped between the spring board 3 and the retainer 4.

In detail, the hair clip will be fixed to the hairs and released therefrom in the following manner.

When the hair retainer 4 is swung towards its closed position, its middle portion will come into contact with the spring board 3 and at the same time the stopping lugs 4f will bear against the shoulders 12b of the brackets 12.

Since both the spring board 3 and the retainer 4 are elastic, the movable end of this retainer can be pressed further towards said board. The hair retainer 4 will flex itself until its arched bridges 4b as the engaging part collide with the lower end of the hooking arms 13.

With the movable end of the hair retainer 4 being further pressed, inner edges of the arched bridges 4b as the engaging part of this retainer will contact the round lower ends of the vertical legs 13b and subsequently be guided towards the upper base ends of those legs, which will therefore be forced to overlap each other more completely.

Upon the arched bridges 4b passing the hooks 13a, the hooking arms 13 will spring open due to the resilient force which has been imparted thereto, whereby said bridges 4b as the engaging part are latched by the hooks 13a.

In this latched state as shown in FIG. 3, the restrainers 15b and 15b facing one another and constituting the annular frame 15 are located outside the hooking arms 13 and fit thereon between the clampable extensions 13c and the hooks 13a.

The releasing of the latched engaging part will be effected by causing the vertical legs 13b of the hooking arms 13 to more completely overlap each other. Details of such an unlatching operation in this embodiment are as follows.

At first, the movable end of the hair retainer 4 will be moved towards the base plate 1.

In consequence of this motion, the arched bridges 4b as the engaging part come into engagement with the restrainers 15b of the annular frame 15, and immediately the inner edges of those restrainers 15b are forced into contact with the lower arcuate edges of clampable extensions 13c of the hooking arms 13. Thus, the arched bridges 4b will indirectly engage with said extensions 13c, with the restrainers 15b thereby intervening between them.

Figure 4A:
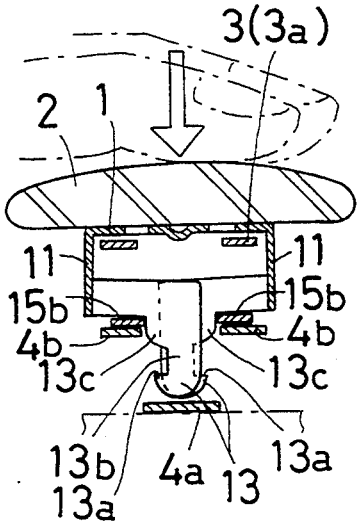
FIGS. 4A to 4C are cross-sectional views which correspond to FIG. 3 and illustrate the process of releasing the hair retainer.

As the hair retainer further advances towards the base plate, the restrainers 15b will be caused to slide upwards along the clampable members 13c. As a result, the vertical legs 13b of the hooking arms 13 will fully overlap each other, as shown in FIG. 4A. In this unlatched state of the arched bridges 4b, the hooks 13a are spaced apart therefrom, and the stopper 15c which has been brought into contact with the base plate will prevent the hair retainer from being displaced any longer towards the base plate.

It will be noted that during the unlatching operation mentioned above neither the arched bridges 4b as the engaging part nor the restrainers 15b are brought into frictional contact with the hooks 13a. Therefore, the hooks 13a are protected from an early abrasion which would cause an imperfect latching of said bridges. Since the arched bridges 4b merely indirectly engage with the sideways extension 13c as the clampable members, said bridges also are protected from partial abrasion which would similarly cause the imperfect latching.

Upon removal of the pressure which has been imparted to the movable end of the hair retainer 4, the stress stored in the spring board 3 and the hair retainer will instantaneously repel the latter away from the base plate, rotating it towards its open position. The arched bridges 4b will thus be displaced downwards past the hooks 13a.

Figure 4B:
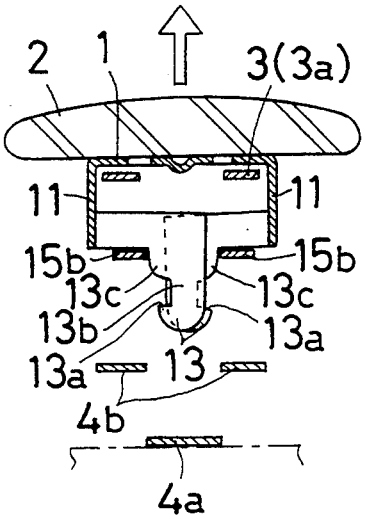
Figure 5A:
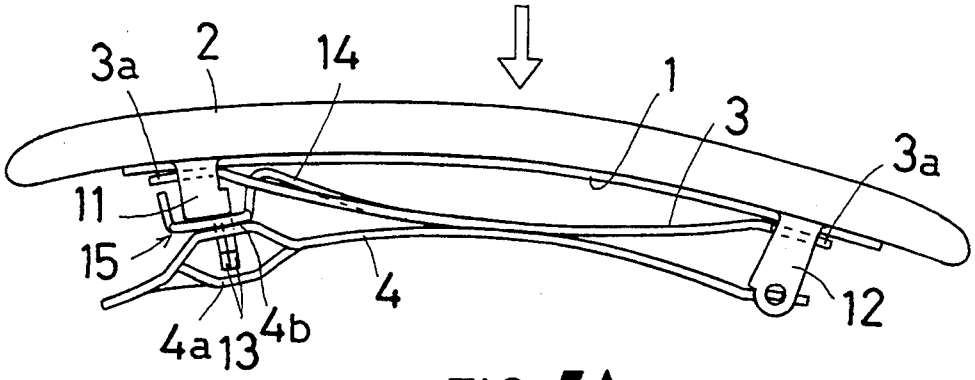
FIGS. 5A to 5C are side elevations which correspond to FIG. 1 and similarly illustrate the releasing process.
Figure 5B:
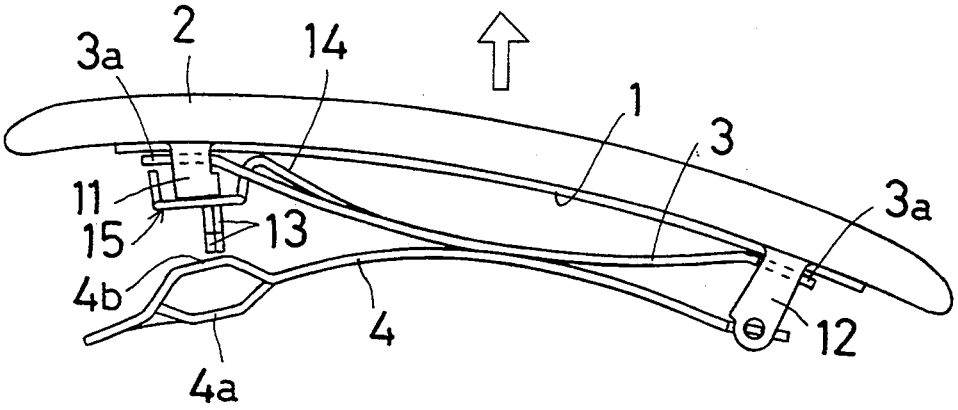

In this state shown in FIGS. 4B and 5B, the restrainers 15b of the annular frame 15 are still on the clampable members 13c of the hooking arms 13, due to a frictional resistance.

Figure 4C:
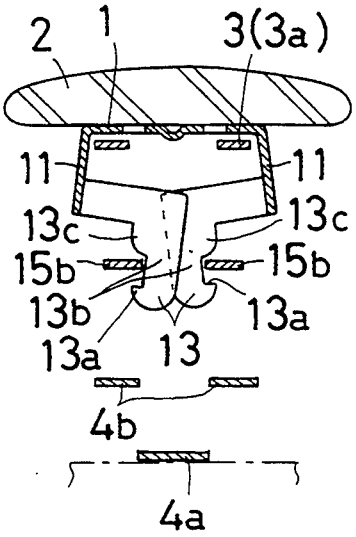
Figure 5C:
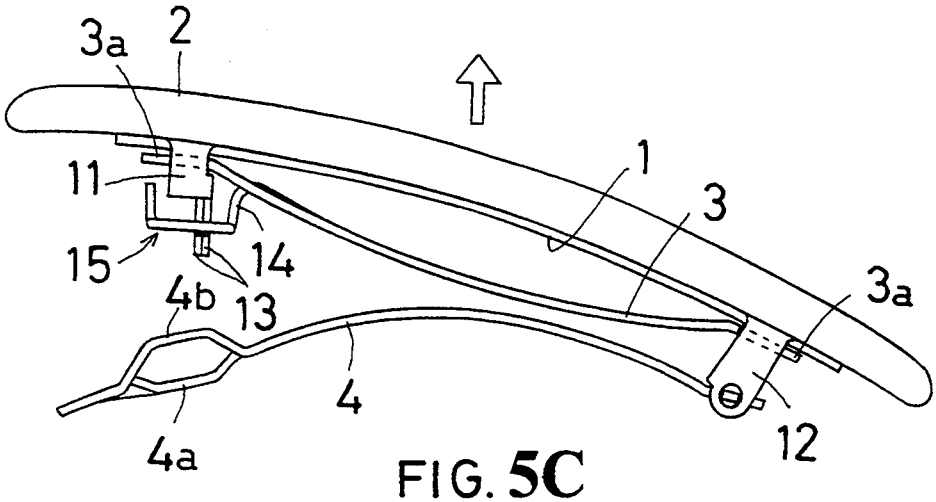

Finally, the hair retainer 4 will further rotate towards its open position, into a state shown in FIGS. 4C and 5C wherein the hair retainer is almost free, or entirely free as shown in FIG. 5C, from the spring board 3. Thus, the spring board 3 returns to its downwardly curved position, thereby urging downwards the elastic tongue 14 integral with said board. The tongue will in turn urge the restrainers 15b towards the hooks 13a along the hooking arms 13, so that said restrainers come back to their position between the clampable members 13c and the hooks 13a, whereby the hooking arms 13 take their home position and their vertical legs 13b are opened outwards.

It will be understood that the hair clip of the present invention can be operated also in the same manner as the prior art hair clips. In other words, the ledges 11 and 11 may be gripped with fingers towards each other in order to cause the vertical legs 13b of the hooking arms 13 to overlap each other, to thereby disengage the hooks 13a from the arched bridges 4b as the engaging part. It may be possible to provide each ledge 11 with a tab or the like (not shown) to facilitate the unlatching operation.

As already detailed above, the releasing means for disengaging the arched bridges 4b of the retainer 4 from the hooking arms of the base plate 1 does comprise the clampable members which are extensions 13c each protruding sideways from the base portion of said arm 13, the annular frame 15 as the shackling member for restraining the arms 13 which fit in this member, and the resilient tongue 14 as the restoring member which connects the annular frame 15 to the spring board 3.

Such a releasing means may be modified in the present invention. For example, the arched bridges 4*b* as the engaging part of the hair retainer 4 may be designed to directly contact the extensions 13*c* of the arms 13. In addition, the annular frame 15 may be replaced with a U-shaped piece as the restraining members, wherein this piece may be connected to the hair retainer 4 so as to engage with and hold in place a pair of protrusions jutting from lower ends of arms 13 when they overlap each other.

The spring board 3 may be attached to the base plate 1 as is the case in the described embodiment, but alternatively be fixed to the hair retainer 4.

In summary, the hair clip provided herein can easily be detached from the hairs of a user just by pressing with her or his hand the end of ornamental cover against her or his head, and by removing the pressure from said cover. Therefore, the user need no longer put her or his fingers uneasily in behind the ornamental cover, when releasing this hair clip. Even if the ornamental cover is so large that the outer edge thereof is considerably remote from the movable end of the retainer, the releasing operation can be done without any difficulty.

The readily releasable hair clip of the invention will be designed by making just a slight change in the design of the existing types of hair clip. The hair clip provided herein is simpler in structure and easier to manufacture and assembly, and thus production cost will be reduced remarkably.

What is claimed is:

1. A hair clip comprising:

a relatively elongated base plate having at one end a pair of hooking arms capable of overlapping each other, each said hooking arms including a base portion and a clampable portion protruding outwardly from said base portion;

a relatively elongated hair retainer having one end rotatably connected to the other end of the base plate, said hair retainer further having at the other end thereof an engaging part releasably latched by said pair of hooking arms;

a spring board interposed between said base plate and said hair retainer and contacting said hair retainer so as to urge said hair retainer towards its open state as long as said engaging part is latched by said hooking arms;

hair retainer releasing means including (a) said clampable portions operative to contact said engaging parts, the clampable portions having a contour such that, when said one end of said base plate is pressed towards said other end of said hair retainer which is in its latched position, said hooking arms are caused to overlap each other to take a releasable position; (b) a shackling member associated with said spring board having means to hold said hooking arms in overlapping state even after said hooking arms have taken said releasable position; and (c) a restoring member on said spring board and having means to urge said shackling member towards a free position for releasing said hooking arms as said hair retainer is rotated away from said base plate toward its open state in which said engaging part is no longer latched by said hooking arms.

2. A hair clip as defined in claim 1, wherein each hooking arm has a hook protruding from an outer edge at an end of the hooking arm.

3. A hair clip as defined in claim 1, wherein the engaging part comprises a pair of sheet portions which are spaced apart a distance from one another such that the hooking arms are capable of forcibly fitting in between the sheet portions.

4. A hair clip as defined in claim 1, wherein each clampable member is formed with an arcuate edge for engaging with the shackling member.

5. A hair clip as defined in claim 1, wherein the shackling member is an annular frame for surrounding the hooking arms.

6. A hair clip as defined in claim 1 wherein said spring board is relatively elongated to define a pair of ends, said restoring member being made of a sheet material and connects said shackling member to said spring board which has both said ends mounted on said base plate and a portion intermediate the ends curved away from said base plate.

7. A hair clip comprising:

a base plate having at one end a pair of hooking arms capable of overlapping each other, with each of the hooking arms having a hook protruding from an outer edge at an end of the hooking arm;

an ornamental cover secured to the base plate;

a hair retainer having one end rotatably connected to the other end of the base plate;

the hair retainer further having at the other end thereof an engaging part releasably latched by the pair of the hooking arms;

a spring board having both ends mounted on the base plate and a portion intermediate the ends and curved away from the base plate, with spring board being shaped so as to urge the hair retainer towards its open state as long as the engaging part is latched by the hooking arms;

a releasing means for releasing the hair retainer from the base plate, the releasing means comprising:

extensions each formed as a clampable member and protruding outwardly from a base portion of the hooking arm;

an annular frame formed as a shackling member, positioned between the extensions and the hooks, and shaped to surround the hooking arms; and a resilient tongue formed as a restoring member and connecting the annular frame to the spring board so that the annular frame is flexible relative to the spring board, wherein the extensions are shaped such that when the one end of the base plate is pressed towards the other end of the hair retainer which is in its latched position, the hooking arms are caused by the extensions to overlap each other to take a releasable position, and wherein the annular frame and the resilient tongue are shaped such that when the one end of the base plate is freed and the hair retainer is rotated to its open position in which the engaging part is no longer latched by the hooking arms, the annular frame is returned by the resilient tongue to its position where the hooking arms are not caused to overlap each other.

8. A hair clip as defined in claim 1 or 7, wherein the end of each hooking arm is round.

9. A hair clip as defined in claim 1 or 7, wherein the spring board relatively elongated to define a pair of ends, said ends being mounted on said base plate and at least one end of the spring board is slidably fixed to said base plate, and a portion intermediate said ends is curved away from said base plate.

10. A hair clip as defined in claim 7 or 5, wherein the annular frame has at its end a stopper extending towards the base plate.

* * * * *